US010594069B2

(12) United States Patent
Kon et al.

(10) Patent No.: US 10,594,069 B2
(45) Date of Patent: Mar. 17, 2020

(54) CONNECTOR

(71) Applicant: Molex, LLC, Lisle, IL (US)

(72) Inventors: Takeshi Kon, Yamato (JP); Nobumasa Motohashi, Yamato (JP); Manabu Yamanaka, Yamato (JP); Ryotaro Takeuchi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/037,818

(22) Filed: Jul. 17, 2018

(65) Prior Publication Data

US 2019/0067864 A1 Feb. 28, 2019

(30) Foreign Application Priority Data

Aug. 24, 2017 (JP) ..... 2017-161245

(51) Int. Cl.

| | |
|---|---|
| ***H01R 13/436*** | (2006.01) |
| ***H01R 13/703*** | (2006.01) |
| ***H01R 13/74*** | (2006.01) |
| ***H01R 12/70*** | (2011.01) |
| ***H01R 13/426*** | (2006.01) |

(52) U.S. Cl.

CPC ..... *H01R 13/436* (2013.01); *H01R 12/7005* (2013.01); *H01R 13/426* (2013.01); *H01R 13/703* (2013.01); *H01R 13/74* (2013.01); *H01R 13/4361* (2013.01)

(58) Field of Classification Search

CPC .... H01R 13/4362; H01R 13/42; H01R 13/74; H01R 13/4226; H01R 13/4223

USPC ..... 439/752, 959

See application file for complete search history.

(56) References Cited

U.S. PATENT DOCUMENTS

| | | | | |
|---|---|---|---|---|
| 5,389,014 A | | 2/1995 | Kumpel et al. | |
| 5,851,128 A | * | 12/1998 | Nakata | H01R 13/4223 439/752 |
| 6,050,861 A | * | 4/2000 | Genta | H01R 13/4362 439/752 |
| 6,402,573 B1 | * | 6/2002 | Yeomans | H01R 13/4362 439/752 |
| 7,048,581 B1 | * | 5/2006 | Wong | H01R 13/426 439/595 |
| 7,682,205 B2 | * | 3/2010 | Hall | H01R 13/4361 439/752 |

(Continued)

FOREIGN PATENT DOCUMENTS

| | | |
|---|---|---|
| CN | 1241052 A | 1/2000 |
| CN | 2452163 Y | 10/2001 |

(Continued)

*Primary Examiner* — Hien D Vu

(74) *Attorney, Agent, or Firm* — Molex, LLC

(57) ABSTRACT

A connector includes a lock member attached to a housing and configured to lock a terminal inside the housing. The lock member includes: a substantially plate-shaped base portion located in an outside of the housing; a first attachment portion provided in the base portion and configured to attach the lock member to the housing; and a locking portion configured to lock the terminal so that the terminal is held inside the housing. The base portion includes a first extension portion formed to extend, from the first attachment portion, in a longitudinal direction of the housing. The first extension portion includes a second attachment portion formed to attach the lock member to the housing.

12 Claims, 8 Drawing Sheets

(56) References Cited

U.S. PATENT DOCUMENTS

| | | | | |
|---|---|---|---|---|
| 8,096,841 | B2 * | 1/2012 | Hirano | H01R 13/4361 439/752 |
| 2015/0004828 | A1 * | 1/2015 | Osada | H01R 13/639 439/357 |
| 2018/0366887 | A1 * | 12/2018 | Motohashi | H01R 24/38 |

FOREIGN PATENT DOCUMENTS

| | | | |
|---|---|---|---|
| CN | 101997228 | B | 1/2014 |
| CN | 104577571 | A | 4/2015 |
| DE | 69910289 | T2 | 6/2004 |
| JP | H10-3959 | A | 1/1998 |
| JP | H10-3972 | A | 1/1998 |
| TW | 200607174 | A | 2/2006 |
| WO | 2013/025335 | A1 | 2/2013 |
| WO | 2015/119788 | A1 | 8/2015 |

* cited by examiner

CONNECTOR

RELATED APPLICATIONS

This application claims priority to Japanese Application No. 2017-161245, filed Aug. 24, 2017, which is incorporated herein by reference in its entirety.

TECHNICAL FIELD

The disclosure relates to a connector including a lock member operable to lock a terminal to a housing.

BACKGROUND ART

Patent Document 1 discloses a lock member (retainer 2 in Patent Document 1) attached to a housing of a connector and operable to lock a terminal inside the housing. The lock member includes attachment portions (a right-hand-side plate portion and a left-hand-side plate portion in Patent Document 1) configured to be attached to the housing. In addition, the lock member may include guide rails (hook-shaped guide rails 20 in Patent Document 1) formed to accept the insertion of a plate-shaped attachment piece (insertion leg 32 in Patent Document 1) formed in a clip or the like operable to attach the connector to a vehicle-body panel.

Patent Document 1: JPH10(1998)-003959 (A)

SUMMARY

In some cases, the guide rails cannot be made smaller in size because, for instance, the attachment piece formed in a clip or the like has a large size, or the size and/or the shape of the guide rails to be formed in the lock member is pre-defined based on some standards. Now, suppose a case where the guide-rail-formed portion is too large for the attachment portion where the guide-rail-formed portion is attached to the housing. In this case, a large force is applied to the attachment portion when the attachment piece is attached to the guide rails. The large force prevents the lock member from being fixed to the housing securely. Hence, the entire lock member may become rickety or even worse, the lock member may come off from the housing.

Hence, the disclosure provides a connector capable of preventing a lock member attached to a housing from becoming rickety or even worse, from coming off from the housing even if an external force is applied to the lock member. To be more specific, the disclosure provides a connector capable of reliably fixing a lock member to a housing even if, for example, the lock member has guide rails to which a clip is to be attached.

(1) An embodiment of a connector proposed by the disclosure includes: a housing; a terminal connected to an end portion of a cable and configured to be inserted into a through-hole formed along a longitudinal direction of the housing and to be connected to a mating connector; and a lock member attached to the housing and configured to lock the terminal inside the housing. In the connector, the lock member includes: a substantially plate-shaped base portion located in an outside of the housing; a first attachment portion provided in the base portion and configured to attach the lock member to the housing; and a locking portion configured to lock the terminal so that the terminal is held inside the housing. The base portion includes an extension portion formed to extend in the longitudinal direction from the first attachment portion. In addition, the extension portion includes a second attachment portion formed to attach the lock member to the housing.

(2) In the connector described in (1), the terminal may include a to-be-locked portion formed to be locked by the locking portion of the lock member. In addition, the housing may include a receptacle configured to accommodate the to-be-locked portion of the terminal. The first attachment portion of the lock member may be configured to engage with the housing in the receptacle of the housing. In addition, the second attachment portion of the lock member may be configured to engage with the housing at a position separated away, in the longitudinal direction, from the receptacle of the housing and thus to attach the lock member to the housing.

(3) In the connector described in (1), the terminal may include: a contact portion configured to be in contact with a terminal of a mating connector; a to-be-locked portion configured to be locked by the locking portion of the lock member; and a coupling portion configured to couple the contact portion and the to-be-locked portion, and the terminal may be formed by integrating the contact portion, the to-be-locked portion, and the coupling portion in the longitudinal direction. In addition, the housing may include: a fitting portion configured to accommodate the contact portion of the terminal and to fit to the mating connector; a receptacle configured to accommodate the to-be-locked portion of the terminal; and a relay portion configured to accommodate the coupling portion and to relay the fitting portion and the receptacle. The first attachment portion of the lock member may be configured to engage with the housing in the receptacle of the housing. The locking portion of the lock member may be configured to engage with the to-be-locked portion of the terminal in the receptacle of the housing. In addition, the second attachment portion of the lock member may be configured to engage with the housing in the relay portion of the housing and thus to attach the lock member to the housing.

(4) In the connector described in any one of (1) to (3), the base portion of the lock member may include a surface which is opposite a surface facing the housing and on which guide rails extending in the longitudinal direction and configured to receive an insertion of a clip member.

(5) In the connector described in any one of (1) to (3), an engagement portion configured to engage with a clip member may be formed in an end portion of the extension portion of the base portion of the lock member and on a surface of the extension portion that is opposite a surface facing the housing. In addition, the second attachment portion may be formed on the surface facing the housing at the same position where the engagement portion is formed.

(6) In the connector described in any one of (1) to (5), the extension portion of the lock member may include a tapered portion formed to include a pair of side faces that are obliquely inclined. In addition, the second attachment portion may be formed in the tapered portion.

DETAILED DESCRIPTION OF THE PREFERRED EMBODIMENTS

An embodiment of a connector proposed by the disclosure will be described below. In the following description, the direction Y1 and the direction Y2 in each drawing are referred to as the forward direction and the rearward direction, respectively. In addition, the direction Z1 and the direction Z2 in each drawing are referred to as the upward direction and the downward direction, respectively. In addition, the direction X1 and the direction X2 in each drawing are referred to as the rightward and the leftward direction, respectively. Note that the nomenclature of directions does not indicate absolute directions whatsoever, but only explains the positional relationships among various components of a connector 1.

Figure 1:
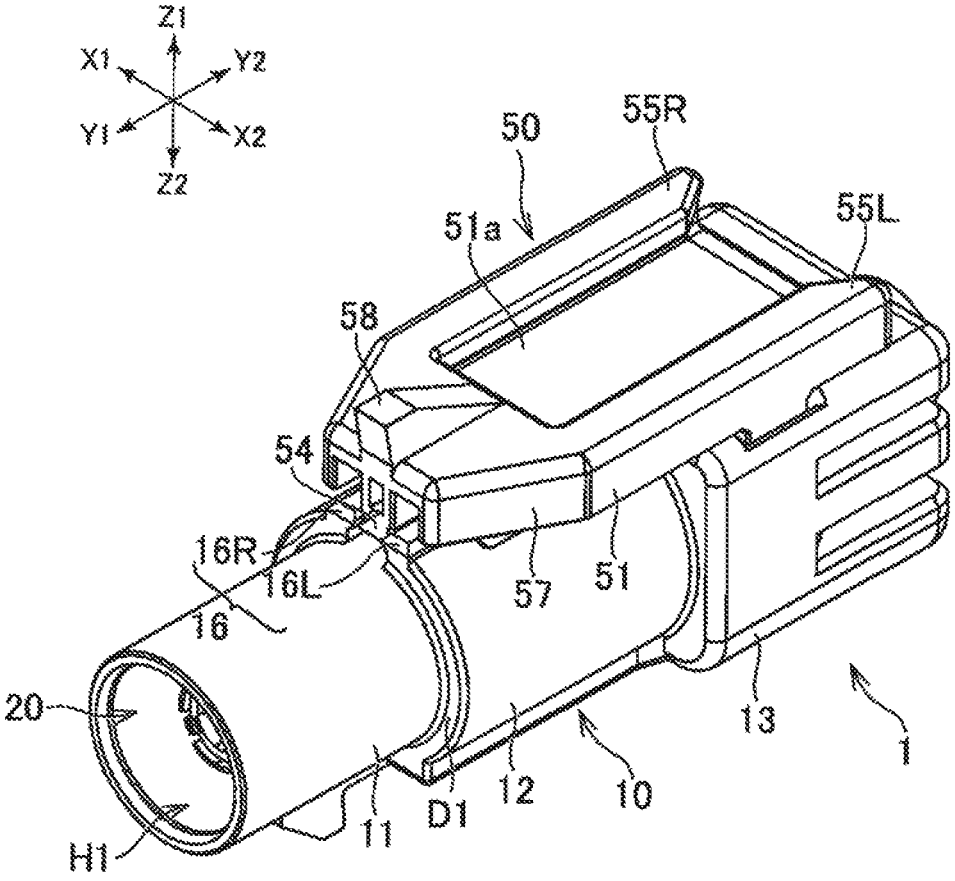
FIG. 1 is a perspective view illustrating an example of a connector proposed by the disclosure.
Figure 2:
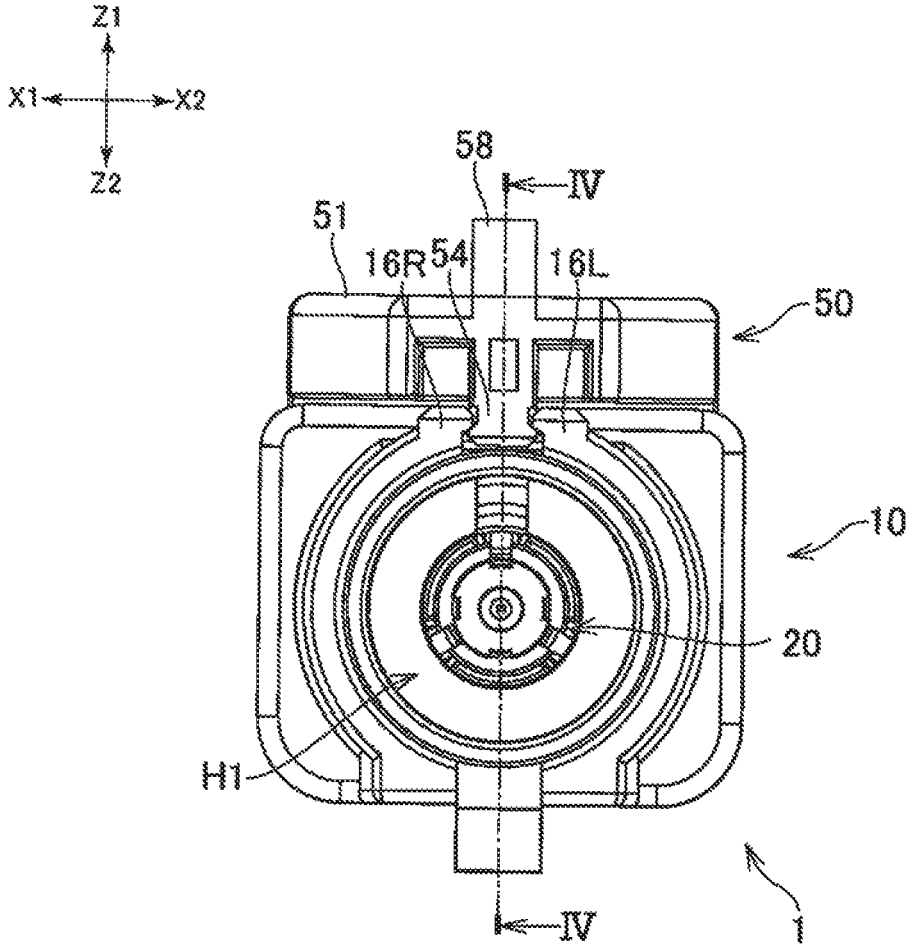
FIG. 2 is a front view illustrating the connector.
Figure 3:
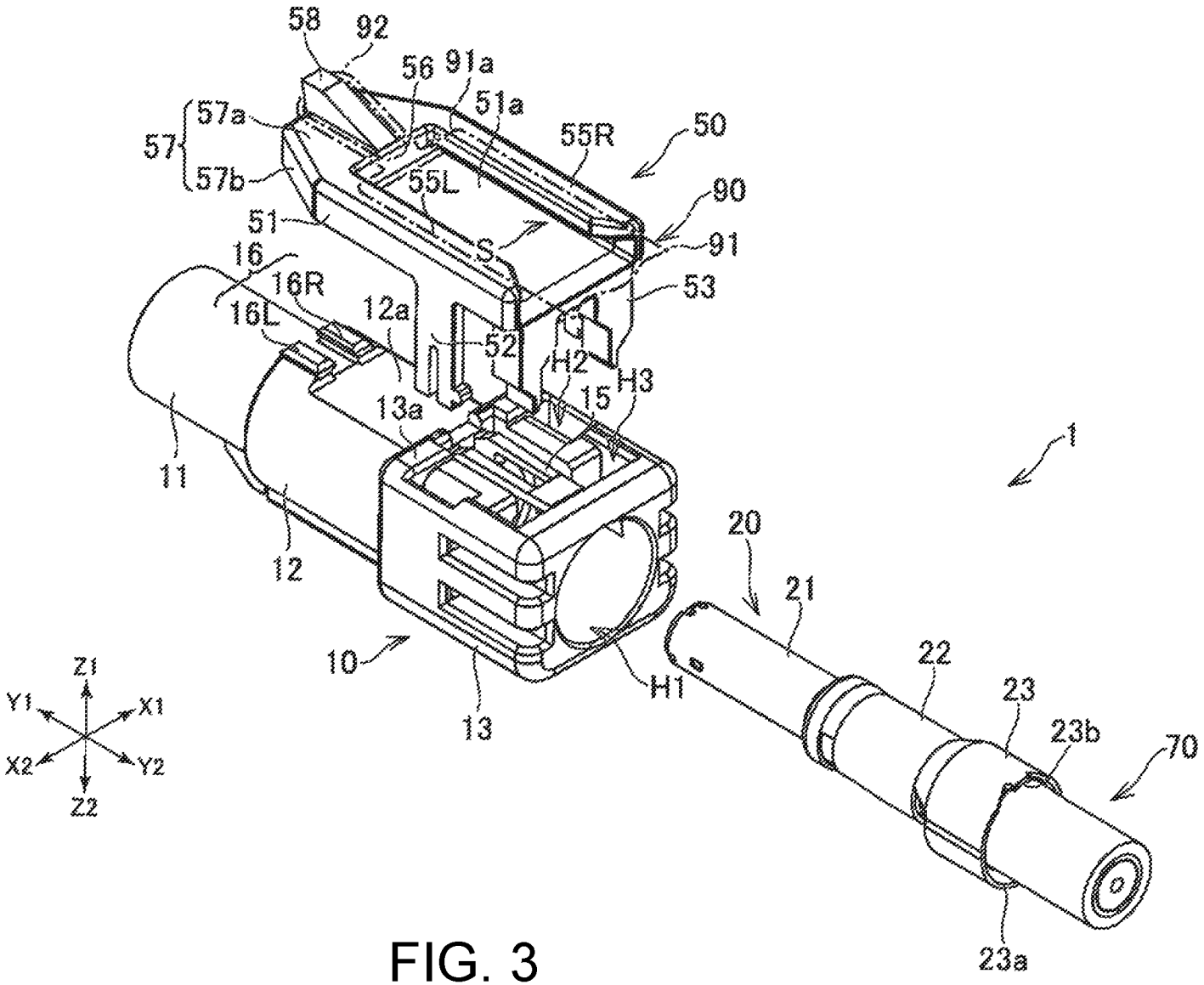
FIG. 3 is an exploded perspective view illustrating components of the connector.
Figure 4:
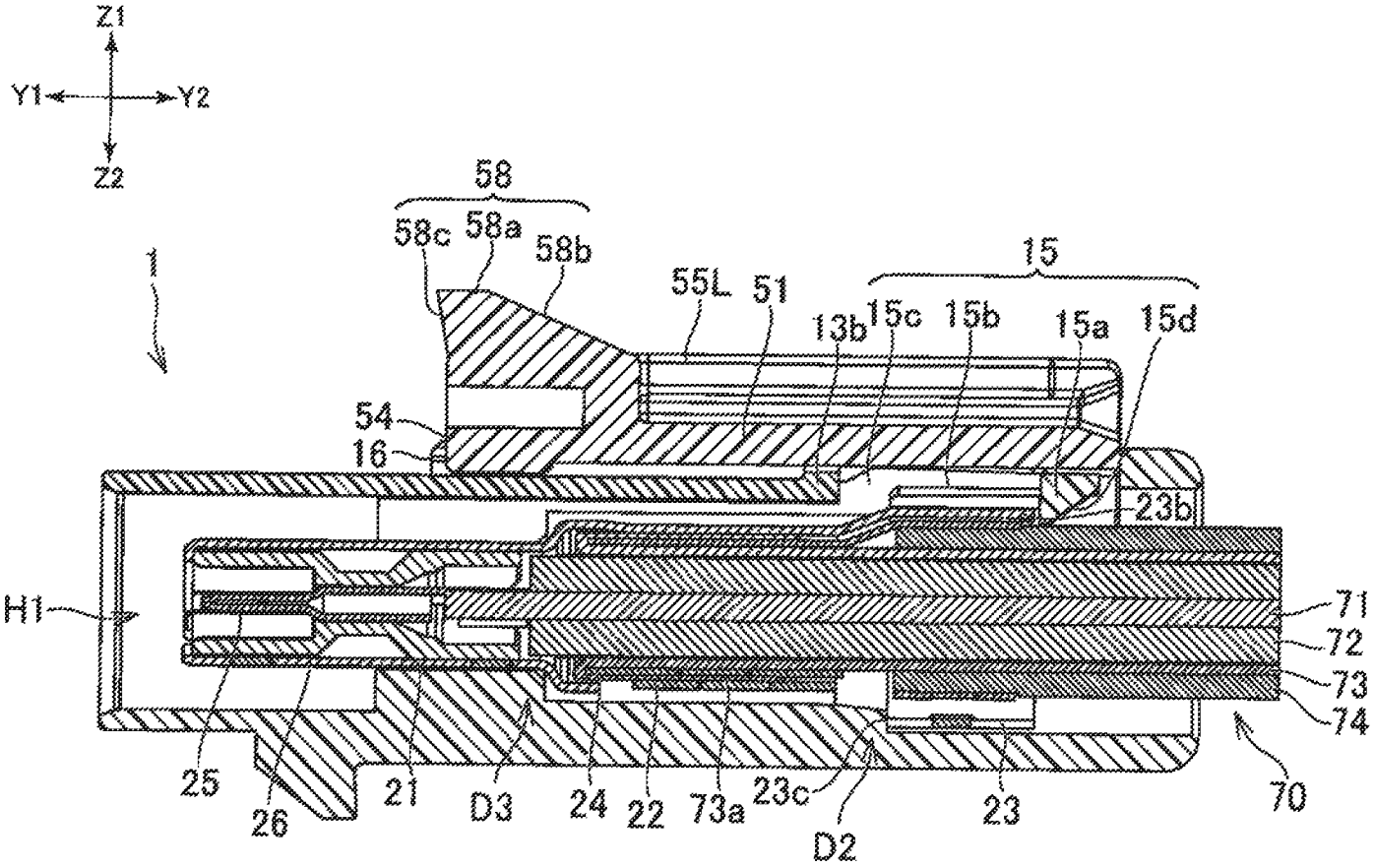
FIG. 4 is a cross sectional view taken along the line IV-IV in FIG. 2.

As illustrated in FIG. 1 and FIG. 3, the connector 1 may include a housing 10 and a terminal 20 attached to an end portion of cable 70. The terminal 20 may be inserted into the housing 10 along the forward-rearward direction (i.e., along the longitudinal direction of the housing 10). As illustrated in FIG. 4, the cable 70 may be what is known as a coaxial cable, and may include a core line 71, an insulator 72, a shield line 73, and an outer sheath 74. In the example illustrated in FIG. 3, the insulator 72, the shield line 73, and the outer sheath 74 have tubular shapes, the core line 71 is disposed inside the insulator 72. The shield line 73 surrounds the outer side of the insulator 72, and the outer sheath 74 wraps the outer side of the shield line 73. Note, however, that the components of the cable 70 and the arrangement of the components are not limited to their respective ones described above.

The terminal 20 may be made from a conductive material such as a metal, and may be formed in a substantially columnar shape extending, as a whole, in the forward-rearward direction. In the example illustrated in FIG. 3 and FIG. 4, the terminal 20 includes a substantially cylindrical-shaped contact portion 21 located in the leading end of the terminal 20 and configured to make contact with the terminal of a mating connector (not illustrated). A central terminal 25 configured to connect with the core line 71 of the cable 70 and a tubular dielectric 26 surrounding the central terminal 25 are disposed inside the contact portion 21. In addition, a substantially cylindrical-shaped coupling portion 22 is formed on the rearward side of the contact portion 21, and the coupling portion 22 is operable to couple the contact portion 21 and the to-be-locked portion 23 (to be described later). The coupling portion 22 is operable to electrically connect the terminal 20 and the shield line 73. The coupling portion 22 wraps the outer side of exposed portion 73*a*, which is a portion of the shield line 73 that is exposed from the outer sheath 74. The coupling portion 22 is in contact with the shield line 73. The coupling portion 22 has a larger outer diameter than the outer diameter of the contact portion 21.

In addition, in the example illustrated in FIG. 3 and FIG. 4, the terminal 20 includes a to-be-locked portion 23 configured to be locked to the inside of the housing 10 by means of a locking portion 15*a* of the housing 10 (to be described later) and locking portions 53 of the lock member 50 (to be described later). The to-be-locked portion 23 is formed to have a tubular shape and surround the outer side of the cable 70 at a further rear-side position than the coupling portion 22. The contact portion 21, the coupling portion 22, and the to-be-locked portion 23 are arranged in line along the forward-rearward direction, and are formed into an integrated body with the to-be-locked portion 23 positioned at a rearmost position in the terminal 20. In addition, only a part of the frontal edge of the to-be-locked portion 23 is coupled to the rear edge of the coupling portion 22. On the upper side of the terminal 20, the frontal edge of the to-be-locked portion 23 is coupled to the rear edge of the coupling portion 22 whereas on the lower side of the terminal 20, the to-be-locked portion 23 is separated from the coupling portion 22. The to-be-locked portion 23 is formed to have a substantially tubular shape, and has a larger outer diameter than the outer diameter of the coupling portion 22. The to-be-locked portion 23 has a rear edge 23*a*, which may be formed in an ellipsoidal shape with its up-and-down-direction length being longer than its left-and-right-direction length. As will be described later, the to-be-locked portion 23 may be used for determining the forward-rearward position of the terminal 20 in the housing 10. Note that the terminal 20 may have a tubular support member 24 configured to hold the shield line 73. In addition, the material, the shape, the components and their positions of the terminal 20 are not limited to those described above.

The housing 10 may be made from an insulating material such as resin, plastics, or the like. In the example illustrated in FIG. 3 and FIG. 4, the housing 10 has a tubular shape extending along the forward-rearward direction, and a through-hole H1 is formed through the housing 10 in the forward-rearward direction. The through-hole H1 is penetrates a fitting portion 11, a relay portion 12, and a receptacle 13 of the housing 10 (which will be described later) in the forward-rearward direction. The terminal 20 may be inserted from the rear side of the through-hole H1 and may be thus accommodated inside the through-hole H1.

In the example illustrated in FIG. 1 and FIG. 3, the housing 10 includes the fitting portion 11 configured to be fitted with a mating connector (not illustrated). The fitting portion 11 may be positioned in a forefront portion of the housing 10, and may be formed in a substantially cylindrical shape extending in the forward-rearward direction. The contact portion 21 of the terminal 20 may be accommodated inside the fitting portion 11. In addition, the housing 10 includes the receptacle 13 configured to accommodate the terminal 20 and a part of the lock member 50 (which will be described later). The receptacle 13 may have a substantially rectangular-parallelepiped shape. The receptacle 13 may have a greater left-and-right-direction dimension and a greater up-and-down-direction dimension than those of the relay portion 12 (which will be described later). The receptacle 13 may be disposed in a rearmost portion of the housing 10. In addition, the receptacle 13 is configured to accommodate the to-be-locked portion 23 of the terminal 20 as well as the first attachment portions 52 and the locking portions 53 of the lock member 50 (which will be described later). The housing 10 also includes the relay portion 12 configured to couple the fitting portion 11 and the receptacle 13, providing a relay between the fitting portion 11 and the receptacle 13. Like the fitting portion 11, the relay portion 12 may be formed in a substantially cylindrical shape extending in the forward-rearward direction, and may have a larger outer diameter than the outer diameter of the fitting portion 11. The mating connector, i.e., the connector fits to the connector 1, may be allowed to move rearwards only by a restricted distance as the leading end of the mating connector is blocked by the front face of the step-like portion D1 (see FIG. 1) formed between the fitting portion 11 and the relay portion 12.

In addition, as illustrated in FIG. 3 and FIG. 4, the housing 10 may include a primary lock portion 15 configured to restrict the rearward movement of the terminal 20. In the example illustrated in FIG. 4, the primary lock portion 15 is formed in the receptacle 13 of the housing 10. The primary lock portion 15 includes a cantilevered spring portion 15*b* and a locking portion 15*a* provided on the rear end of the spring portion 15*b*. The terminal 20 is allowed to move rearwards only by a restricted distance as the rear edge of the terminal 20, i.e., the rear-edge upper portion 23*b* of the to-be-locked portion 23 is stopped by the locking portion 15*a*. The frontal end of the spring portion 15*b*, i.e., a base portion 15*c*, is coupled to a frontal edge 13*b* of the receptacle 13. The spring portion 15*b* extends rearwards from the base portion 15*c*. A guide face 15*d* extending obliquely rearwards and upwards is formed on the rear side of the locking portion 15*a*. When the terminal 20 is inserted into the through-hole H1 from the rear side of the housing 10, the guide face 15*d* is stopped by the to-be-locked portion 23 of the terminal 20 and thus the spring portion 15*b* is elastically deformed upwards, allowing the terminal 20 to be inserted into the housing 10. Once the terminal 20 is inserted to reach the position illustrated in FIG. 4, the elastically deformed spring portion 15*b* is released from the elastically deformed state, and thus the locking portion 15*a* is positioned on the rear side of the upper portion 23*b* of the rear edge 23*a* of the terminal 20.

In addition, as illustrated in FIG. 4, on the inner side of the through-hole H1 of the housing 10, a step-like portion D2 may be formed to restrict the forward movement of the terminal 20. The forward movement of the terminal 20 may be restricted by making the rear-side face of this step-like portion D2 stop the frontal edge 23*c* of the to-be-locked portion 23 of the terminal 20. In addition, in the through-hole H1, a step-like portion D3 may be formed at a further frontal side of the step-like portion D2. The step-like portion D3 may be formed to have an annular or a circular arc shape. The step-like portion D3 may cover the circumference of the contact portion 21 of the terminal 20 and support the contact portion 21. As such, the movement of the leading end of the terminal 20 in the up-and-down direction and in the left-and-right direction is restricted. Note that the step-like portion D2 and the step-like portion D3 may be formed to cover an entire part of a circumferential area surrounding all around terminal 20 in the circumferential direction, or to cover only a part of the circumferential area.

In addition, in the example illustrated in FIG. 3, the receptacle 13 of the housing 10 includes a flat top surface 13*a* that faces upwards. A left and right pair of attachment holes H2 and a left and right pair of attachment holes H3 are formed in the top surface 13*a* of the receptacle 13. The first attachment portions 52 of the lock member 50 are attached to the attachment holes H2 whereas the locking portions 53 of the lock member 50 are attached to the attachment holes H3 (which will be described later). The attachment holes H2 are formed on the left-hand side and on the right-hand side of the primary lock portion 15, one on each side. The attachment holes H3 are also formed on the left-hand side and on the right-hand side of the primary lock portion 15, one on each side. The attachment holes H3 are located at further rear side positions than the attachment holes H2. Inside the housing 10, both the attachment holes H2 and the attachment holes H3 are connected to the through-hole H1. In addition, a to-be-attached portion 16 is formed in the housing 10. A second attachment portion 54 of the lock member 50 (which will be described later) is attached to the to-be-attached portion 16. In the example illustrated in FIG. 1, in the housing 10, the to-be-attached portion 16 including a left and right pair of engagement protrusions 16L and 16R is formed in a forefront portion on the upper side of the relay portion 12. The engagement protrusions 16L and 16R are separated away from each other in the left-and-right direction. The second attachment portion 54 (which will be described later) is attached to the engagement protrusions 16L and 16R. Details of the to-be-attached portion 16 will be described later. Note that the relay portion 12 may include a flat top surface 12*a* that faces upwards, and the left and right engagement protrusions 16L, 162R may protrude upwards from the top surface 12*a*.

In addition, as illustrated in FIG. 3, the connector 1 may include the lock member 50 attached to the housing 10 and configured to lock the terminal 20 inside the housing 10. To attach the lock member 50 to the housing 10, the lock member 50 may be oriented in the up-and-down direction. In the example illustrated in FIG. 3, lock member 50 is attached to the upper side of the housing 10. Like the housing 10, the lock member 50 may be made from an insulating material such as resin, plastics, or the like. In the example illustrated in FIG. 3 and FIG. 4, the lock member 50 includes a base portion 51 which have a substantially plate-like shape extending in the forward-rearward direction. The base portion 51 covers the relay portion 12 and the receptacle 13 of the housing 10. In addition, in the example illustrated in FIG. 5, the base portion 51 includes a front-side bottom surface 51*b* and a rear-side bottom surface 51*c* that is positioned at a lower level than the front-side bottom surface 51*b*. The rear-side bottom surface 51*b* may cover the primary lock portion 15 of the housing 10. As such, restriction is provided to the upward elastic deformation of the spring portion 15*b* of the primary lock portion 15. In addition, the rear-side bottom surface 51*c* may be configured to be in contact with the top surface 13*a* of the receptacle 13 (see FIG. 3) at positions located on the left-hand side and on the right-hand side of the primary lock portion 15. Thus, suppressed is the left-and-right-direction tilting movement of the lock member 50.

As described earlier, the base portion 51 of the lock member 50 has a substantially plate-like shape extending in the forward-rearward direction. In the example illustrated in FIG. 5 and FIG. 7, the base portion 51 includes a first extension portion 511 and a second extension portion 512. The first extension portion 511 extends forwards from the first attachment portion 52, which is configured to be attached to the housing 10 (which will be described later). The second extension portion 512 extends rearwards from the first attachment portion 52. The first extension portion 511 includes the foremost portion of the base portion 51 and a tapered portion 57 (which will be described later). The second extension portion 512 includes the rearmost portion of the base portion 51 and the rear ends of the guide rails 55L and 55R (which will be described later). The tapered portion 57 includes a left and right pair of side faces 57*b* that are obliquely inclined to make the tapered portion 57 has decreasing left-and-right-direction width towards the front. In the example illustrated in FIG. 3, the tapered portion 57 has a frontal face 57*c* having a wider left-and-right-direction width than the left-and-right-direction width of the relay portion 12 of the housing 10, to which the second attachment portion 54 is attached (which will be described later). In addition, the frontal face 57*c* of the tapered portion 57 is located, in the forward-rearward direction, at a slightly further rear-side position than the step-like portion D1 between the fitting portion 11 and the relay portion 12 of the housing 10. As such, wirings such as the cable coming around from the front side of the connector 1 are prevented from being caught by the frontal face 57*c* of the tapered portion 57.

In addition, in the example illustrated in FIG. 3, a left-and-right pair of guide rails 55L and 55R are formed, respectively, in the left-hand-side edge portion and in the right-hand-side edge portion of a top surface 51*a* of the base portion 51. A clip member 90 (which will be described later) is inserted between the guide rails 55L and 55R. Between each of the guide rails 55L and 55R and the top surface 51*a* of the base portion 51, a space S is formed to accept the insertion of the clip member 90. The pair of guide rails 55L and 55R are separated away from each other in the left-and-right direction, and have symmetrical shapes to each other in the left-and-right direction. The guide rails 55L and 55R are formed to extend in the forward-rearward direction from the rear end of the second extension portion 512 to a middle portion of the first extension portion.

Figure 5:
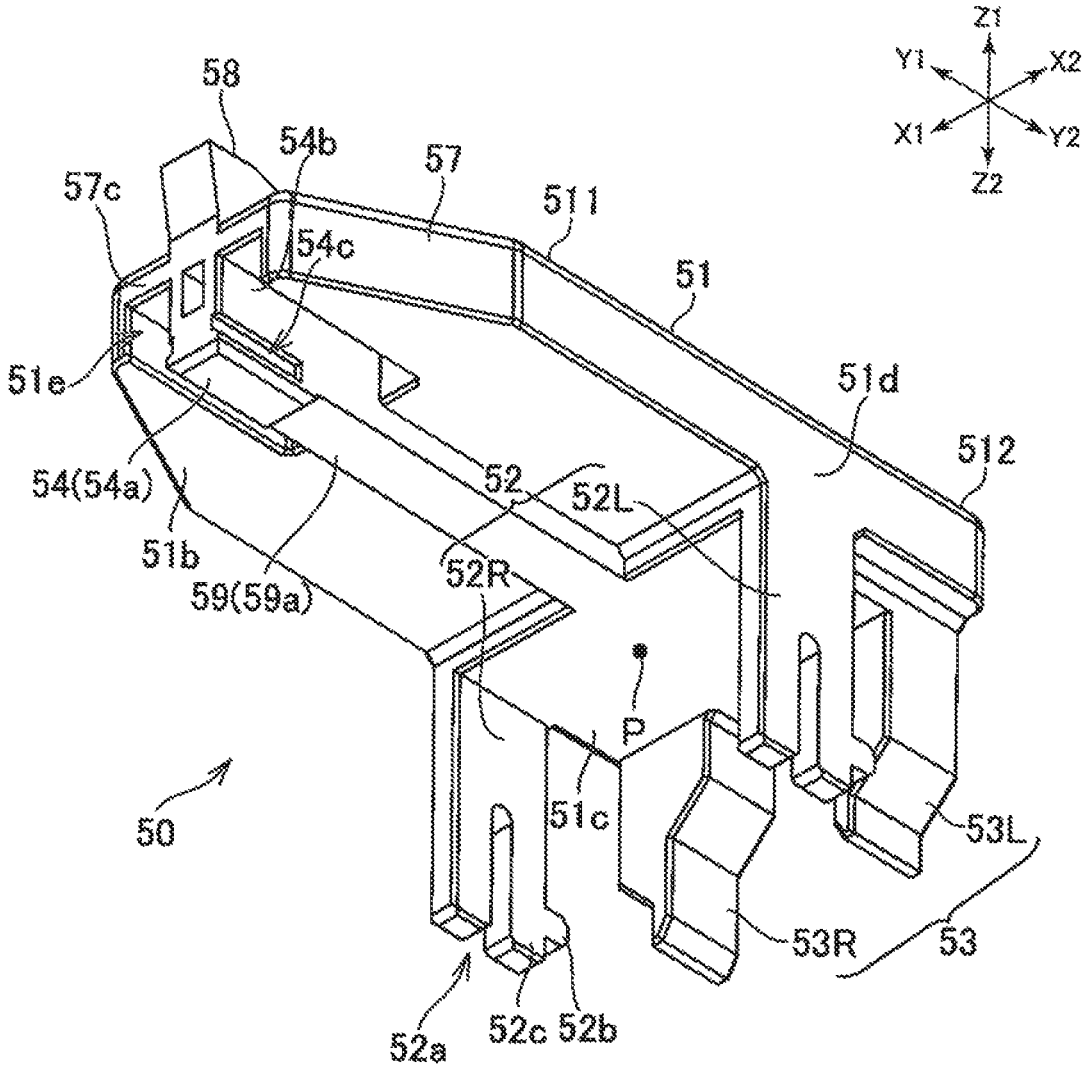
FIG. 5 is a perspective view illustrating a lock member configured to be attached to the connector.

In addition, in the example illustrated in FIG. 3 and FIG. 5, an engagement portion 58 configured to engage with the clip member 90 is formed on the top surface of the forefront portion of the base portion 51, i.e., the forefront portion of the first extension portion 511. The engagement portion 58 is located at the central position in the left-and-right direction of the lock member 50. The engagement portion 58 has a shape protruding upwards from the top surface of the tapered portion 57. As illustrated in FIG. 4, the engagement portion 58 may include: a top surface 58*a* facing upwards; a slope face 58*b* connected to the rear end of the top surface 58*a* and extending obliquely upwards and forwards; and a frontal face 58*c* located in the forefront portion of the engagement portion 58. When the clip member 90 is inserted between the guide rails 55L and 55R, a protruding plate portion 92 (which will be described later) moves along the slope face 58*b* of the engagement portion 58, and runs on the top surface 58*a*. After that, the protruding plate portion 92 is caught by the frontal face 58*c* of the engagement portion 58.

The clip member 90 is configured to, for example, attach the connector 1 to the vehicle-body panel or the like. As illustrated in FIG. 3, the clip member 90 may include a plate-shaped attachment piece 91. The attachment piece 91 may be a rectangular plate, and may be held by both of the guide rails 55L and 55R. The attachment piece 91 may have a thickness that is thin enough to pass through the spaces S between the top surface 51*a* of the base portion 51 and each of the guide rails 55L and 55R. The attachment piece 91 may be inserted into the spaces S from the rear side of the lock member 50. In addition, the tongue-shaped protruding plate portion 92 may be formed in the leading end portion of the clip member 90. In the tongue-shaped protruding plate portion 92, a hole is formed to engage with the engagement portion 58 of the lock member 50. The engagement of this hole of the protruding plate portion 92 with the engagement portion 58 prevents the lock member 50 and the connector 1 from being disconnected from the clip member 90. In the example illustrated in FIG. 4, the frontal face 58*c* of the engagement portion 58 is obliquely inclined upwards and forwards. As such, the protruding plate portion 92 becomes less likely to be disengaged from the engagement portion 58. Note that the clip member 90 may include an unillustrated protrusion for attachment that may fit in a hole, a recess, or the like structures formed in the vehicle-body panel or the like members. Note, however, that the shape, the functions, and the use of the clip member 90 are not limited to those described above. Specifically, the member configured to be inserted between the guide rails 55L and 55R is not limited to the above-described clip member 90.

In addition, in the example illustrated in FIG. 3, a locking surface 56 configured to lock the clip member 90 is formed at the frontal ends of the guide rails 55L and 55R of the lock member 50. The locking surface 56 rises from the top surface 51*a* of the base portion 51, and is connected to a top surface 57*a* of the tapered portion 57 and the slope face 58*b* of the engagement portion 58. Once the clip member 90 is inserted between the guide rails 55L and 55R from the rear side of the lock member 50, further forward movement of the clip member may be restricted by making the locking surface 56 stop a frontal-end shoulder portion 91*a* of the attachment piece 91. Hence, unintentional dislocation of the clip member 90 from the guide rails 55L and 55R is prevented. Note that the top surface 57*a* of the tapered portion 57 is on the same plane as the top surfaces of the guide rails 55L and 55R.

Figure 6:
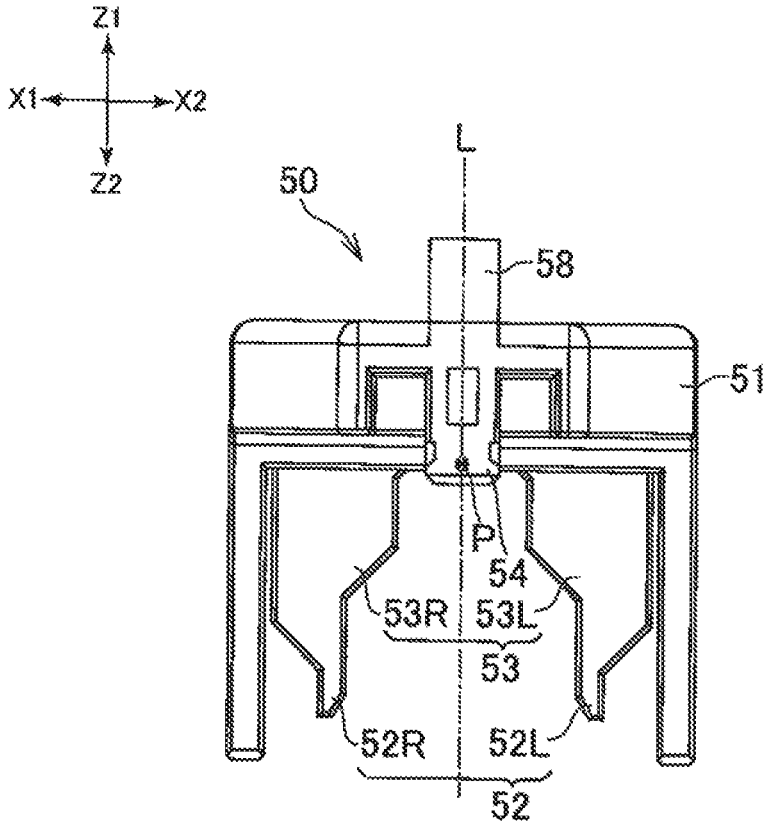
FIG. 6 is a front view illustrating the lock member.
Figure 7:
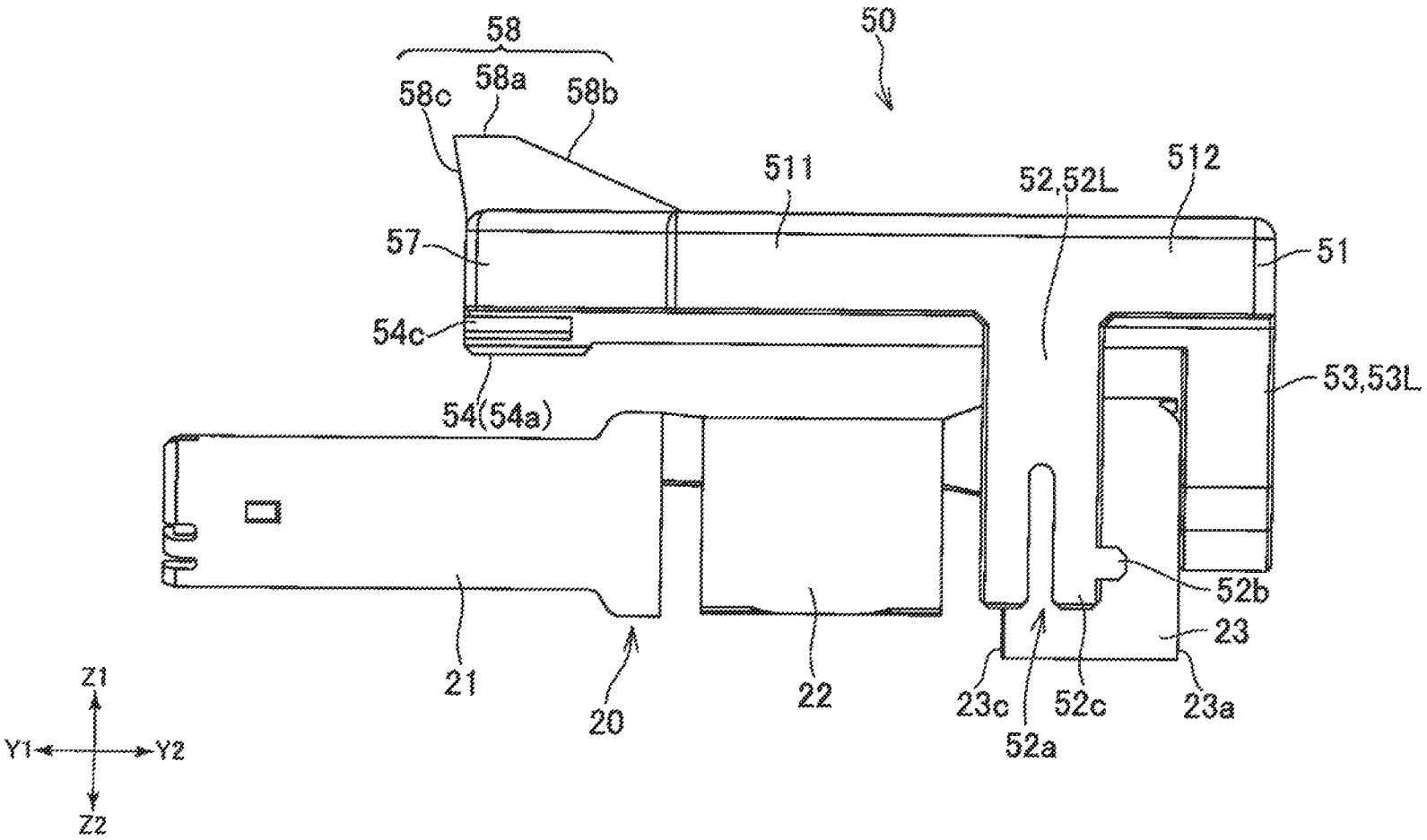
FIG. 7 is a side elevation view illustrating a positional relationship between a terminal and the lock member.

In addition, as illustrated in FIG. 5 and FIG. 7, the lock member 50 may include the locking portions 53 configured to lock the terminal 20 so that the terminal 20 is held in the inside of the housing 10. When the terminal 20 and the lock member 50 are attached to the housing 10, the locking portions 53 are positioned at further rear-side positions than the rear edge 23*a* of the to-be-locked portion 23 of the terminal 20. Thus, the rearward movement of the terminal 20 is restricted. In addition, in the example illustrated in FIG. 5 and FIG. 6, the locking portions 53 include a left-and-right pair of locking protrusions 53L and 53R. The two locking protrusions 53L and 53R extend downwards from the rear side of the base portion 51, specifically from the bottom surface 51*c* of the second extension portion 512. The two locking protrusions 53L and 53R are separated away from each other, one being on the left-hand side and the other on the right-hand side of the housing 10. In the left-and-right direction, the two locking protrusions 53L and 53R have symmetrical shapes to each other with respect to the vertical line Z passing on the center of the lock member 50. As illustrated in FIG. 3 and FIG. 7, the two locking protrusions 53L and 53R are individually inserted into the corresponding two attachment holes H3 formed in the receptacle 13 of the housing 10, and thus are positioned on the left-hand side and on the right-hand side, one on each side, of the primary lock portion 15 of the housing 10. In addition, as the two locking protrusions 53L and 53R are located at further rear-side positions than the to-be-locked portion 23 of the terminal 20, the locking portions 53 including the locking protrusions 53L and 53R engage with the to-be-locked portion 23. Note that the locking portions 53 have only to engage with the to-be-locked portion 23 of the terminal 20. The shape of the locking portion 53 is not limited to the above-described one. The number, the shapes, and the positions of the locking protrusions 53L and 53R are not limited to the above-described ones.

In addition, in the example illustrated in FIG. 5, the lock member 50 includes the first attachment portions 52 configured to be attached to the housing 10. The first attachment portions 52 include a left-and-right pair of attachment arms 52L and 52R extending in the up-and-down direction respectively from the left-hand-side and the right-hand-side side faces 51*d* of the base portion 51. The attachment arms 52L and 52R are separated from each other in the left-and-right direction. As such, because the first attachment portions 52 include a left-and-right pair of attachment arms 52L and 52R, the lock member 50 attached to the housing 10 is prevented from being rickety in the left-and-right direction.

In addition, the distance between the two attachment arms 52L and 52R is wider than the distance between the two locking protrusions 53L and 53R. Moreover, the two attachment arms 52L and 52R have substantially identical shapes to each other. Each of the attachment arms 52L and 52R has a rectangular flat-plate shape having a width in the forward-rearward direction as a whole. As illustrated in FIG. 7, each of the attachment arms 52L and 52R includes: a slit 52*a* cutting in upwards from the bottom end of each of the attachment arms 52L and 52R; and an engagement protrusion 52*b* protruding rearwards from a rear-side arm portion 52*c*, which is the rear-side one of the two segments formed by dividing, with the slit 52*a*, each of the attachment arms 52L and 52R into a front-side and a rear-side segments.

The first attachment portions 52 may engage with the housing 10 by engaging with the receptacle 13 of the housing 10. The two attachment arms 52L and 52R included in the first attachment portions 52 may be inserted into the two attachment holes H2 (see FIG. 3) formed in the housing 10, one arm into each hole, and may thus be positioned in the inside of the housing 10. In this event, the engagement protrusion 52*b* formed in the rear-side arm portion 52*c* of each of the attachment arms 52L and 52R may be stopped by an unillustrated protrusion of the housing 10. The engagement protrusion 52*b* may be allowed to run on the protrusion of the housing 10 by the forward elastic deformation of the rear-side arm portion 52*c* extending in the up-and-down direction. Once the entire first attachment portions 52 are accommodated in the attachment holes H2, the rear-side arm portions 52*c* are released from the elastically deformed state. Thus, the engagement protrusions 52*b* are positioned below the corresponding protrusions of the housing 10 and thus the engagement protrusions 52*b* are caught by the corresponding protrusions of the housing 10.

In addition, in the example illustrated in FIG. 1 and FIG. 5, the second attachment portion 54 configured to be attached to the housing 10 is formed in the first extension portion 511 of the base portion 51 of the lock member 50. The second attachment portion 54 may be formed on the underside of the first extension portion 511, and may be attached to the to-be-attached portion 16 formed at the frontal end of the relay portion 12 of the housing 10. In the example illustrated in FIG. 5, the second attachment portion 54 is separated away from the first attachment portions 52 in the forward-rearward direction. As such, the second attachment portion 54 engages with the housing 10 at the relay portion 12, which is separated away from the receptacle 13 of the housing 10 in the forward-rearward direction. By means of the engagement, the lock member 50 is attached to the housing 10. In addition, the second attachment portion 54 is located at a further front-side position away from the middle position P between the two attachment arms 52L and 52R. As illustrated in FIG. 6, when the lock member 50 is viewed from the front side, the second attachment portion 54 is positioned on the vertical line Z passing on the center of the lock member 50 in the left-and-right direction. As described earlier, because the first attachment portions 52 include the left-and-right pair of attachment arms 52L and 52R and because the second attachment portion 54 is located at a further front-side position than the middle position P between the two attachment arms 52L and 52R, the lock member 50 is attached to the housing 10 at three positions that are arranged in an isosceles triangle. As such, the lock member 50 is prevented from being rickety in the left-and-right direction and in the forward-rearward direction, and the lock member 50 is securely fixed to the housing 10 so that the lock member 50 is prevented from coming off from the housing 10.

In addition, in the example illustrated in FIG. 5, the second attachment portion 54 is formed in the forefront portion of the first extension portion 511. As such, the forefront portion of the first extension portion 511 is prevented from being rickety in the left-and-right direction and in the up-and-down direction. In addition, the second attachment portion 54 is formed in the tapered portion 57. As such, the tapered portion 57 is reliably prevented from moving relative to the housing 10. In addition, wirings such as the cable coming around from the front side of the connector 1 are prevented more effectively from being caught by the frontal face 57*c* of the tapered portion 57.

In addition, in the example illustrated in FIG. 5, the second attachment portion 54 of the lock member 50 is formed on the underside of the base portion 51. In the up-and-down direction, the second attachment portion 54 is located on the opposite side of the first extension portion 511 to the side where the engagement portion 58 is located. In addition, the second attachment portion 54 has a narrower left-and-right-direction width than the frontal face 57*c* of the tapered portion 57. The second attachment portion 54 has a bottom surface 54*a*, which is positioned at a lower level than the front-side bottom surface 51*b* of the base portion 51. Recesses 51*e*, which are recessed upwards from the front-side bottom surface 51*b* of the base portion 51*b*, may be formed on the left-hand side and on the right-hand side of the second attachment portion 54.

In addition, in the example illustrated in FIG. 5, a beam portion 59 extending rearwards from the second attachment portion 54 is formed in the lock member 50. The beam portion 59 has a substantially rectangular-column shape, and has a substantially the same width in the left-and-right direction as the corresponding width of the second attachment portion 54. As such, because the beam portion 59 is formed in the lock member 50, the lock member 50 has an improved strength against bends and cracks. Note that the beam portion 59 protrudes downwards from the front-side bottom surface 51*b* of the base portion 51, and is connected to the rear-side bottom surface 51*c*. In addition, the beam portion 59 has a bottom surface 59*a* that is on the same plane as the rear-side bottom surface 51*c*. The bottom surface 54*a* of the second attachment portion 54 is located at a lower level than the bottom surface 59*a* of the beam portion 59.

Figure 8:
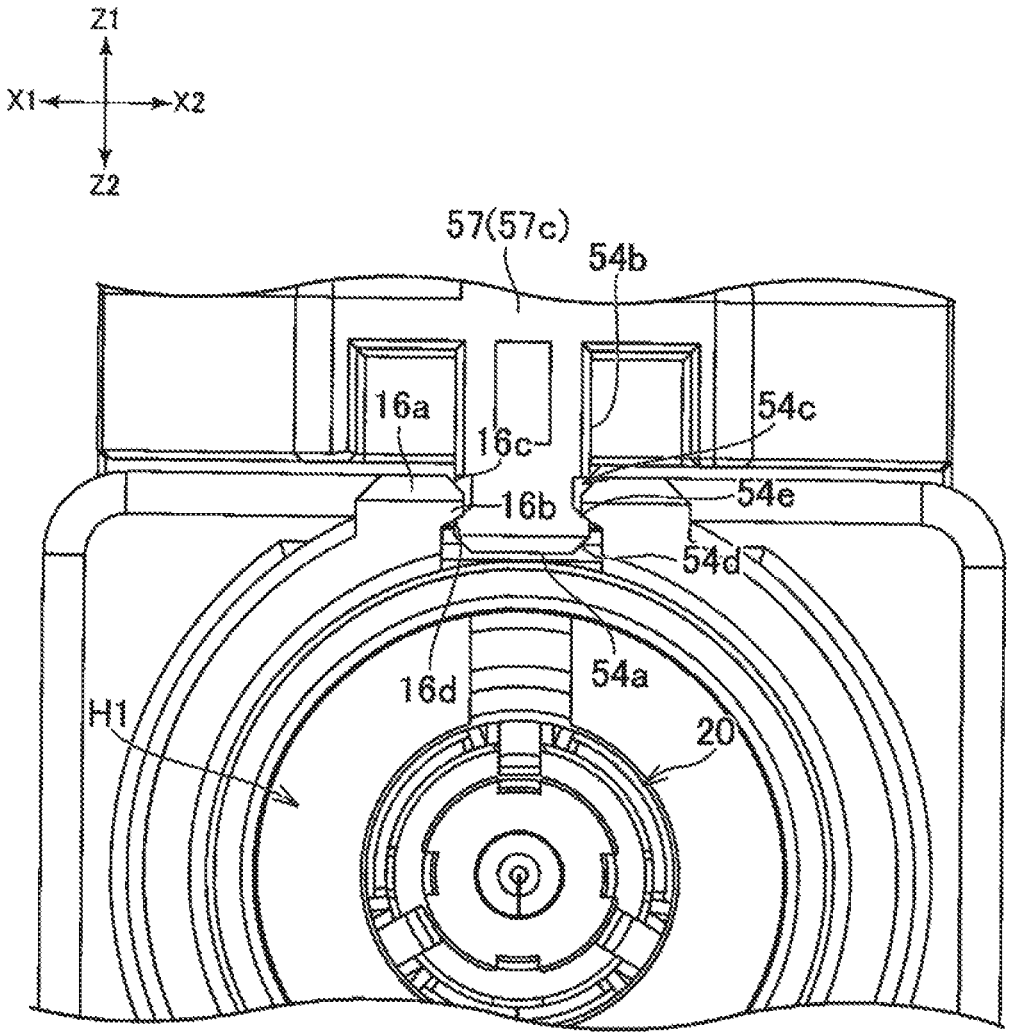
FIG. 8 is an enlarged view of FIG. 2.

Next, an exemplar detail shape of the second attachment portion 54 and an exemplar detail shape of the to-be-attached portion 16 will be described below. As illustrated in FIG. 8, the second attachment portion 54 of the lock member 50 is formed in a rectangular shape surrounded by: a left-and-right pair of side faces 54*b*, which face leftwards and rightwards, respectively; the bottom surface 54*a*; and a part of the frontal face 57*c* of the tapered portion 57. The left-and-right pair of side faces 54*b* respectively have left-and-right pair of recesses 54*c* formed at the same level in the up-and-down direction. Each of the recesses 54*c* is recessed from the corresponding one of the side faces 54*b* either rightwards or leftwards. In addition, each of the recesses 54*c* is formed in a groove shape extending in the forward-rearward direction. In addition, as illustrated in FIG. 1 and FIG. 8, the left-and-right pair of engagement protrusions 16L and 16R included in the to-be-attached portion 16 have their respective protrusions 16*b* configured to fit in the recesses 54*c* of the lock member 50. The left-and-right pair of protrusions 16*b* are formed at positions opposite each other. The left-and-right pair of protrusions 16*b* protrude in the left-and-right direction so that the protrusions face each other. As such, because the left-and-right pair of protrusions 16*b* fit respectively in the left-and-right pair of recess 54*c*, the second attachment portion 54 is fixed between the left-and-right pair of engagement protrusions 16L and 16R included in the to-be-attached portion 16.

The bottom surface 54*a* of the second attachment portion 54 has slope faces 54*d* formed by chamfering the left-hand-side edge and the right-hand-side edge of the bottom surface 54*a*. In addition, a top surface 16*a* of each of the engagement protrusions 16L and 16R included in the to-be-attached portion 16 has slope faces 16*c* formed by chamfering the left-hand-side edge and the right-hand-side edge of the top surface 16*a*. As such, when the operator attaches the second attachment portion 54 to the housing 10, the slope faces 54*d* and the slope faces 16*c* become in contact with each other. Thus, the second attachment portion 54 is guided to the position between the left and the right engagement protrusions 16L and 16R. In addition, an inner face 54*e* of the bottom side of each of the recesses 54*c* may face obliquely upwards and outwards whereas each of the protrusion 16*b* has a bottom surface 16*d* that may face obliquely downwards and inwards. As such, the second attachment portion 54 is more easily pulled upwards out from the position between the two engagement protrusions 16L and 16R included in the to-be-attached portion 16.

As has been described thus far, in an embodiment of the connector proposed by the disclosure, the first extension portion 511 extending forwards from the first attachment portion 52 is formed in the base portion 51 of the lock member 50. In addition, the second attachment portion 54, which is configured to be attached to the housing 10, is formed in the first extension portion 511. As such, the first extension portion 511 extending forwards from the first attachment portion 52 formed in the lock member 50 is securely fixed to the housing 10. Hence, even if an external force is applied to the lock member 50, the entire lock member 50 is prevented from being rickety and the lock member 50 is prevented from being dislocated from the housing 10.

An embodiment of the connector proposed by the disclosure has been described thus far, but the invention is not limited to the above-described embodiment. Various modifications may be made to such an embodiment. The materials, the shapes, the components of the housing 10 and those of the lock member 50, as well as the positions of the components are not limited to those described in the embodiment above. For example, in the lock member 50, the second attachment portion 54 to be attached to the housing 10 may be formed in second extension portion 512 extending rearwards from the left-and-right pair of first attachment portions 52. In this case, in the housing 10, the to-be-attached portion 16 to which the second attachment portion 54 is to be attached may be located at a further rear-side position than the attachment holes H2 to which the first attachment portions 52 are attached. As such, the second extension portion 512 extending rearwards from the first attachment portion 52 is securely fixed to the housing 10. For example, the second attachment portion 54 may be formed in the rearmost portion of the second extension portion 512.

In addition, the second attachment portion 54 may be formed in either of or both of the first extension portion 511 and the second extension portion 512. In addition, the lock member 50 does not have to include the guide rails 55L and 55R. In addition, either one of the first extension portion 511 and the second extension portion 512 may be omitted from the base portion 51 of the lock member 50. If the first attachment portions 52 are formed in the rearmost portion of the base portion 51, the base portion 51 includes only the first extension portion 511. In this case, the second attachment portion 54 may be formed in this first extension portion 511. In addition, if the first attachment portion 52 is formed in the forefront portion of the base portion 51, the base portion 51 includes only the second extension portion 512. In this case, the second attachment portion 54 may be formed in this second extension portion 512.

In addition, the above-described embodiment has a configuration where the first attachment portions 52 and the second attachment portion 54 extend downwards from the substantially plate-shaped base portion 51 extending in the forward-rearward direction. The first attachment portions 52 is attached to the attachment holes H2 of the housing 10 whereas the second attachment portion 54 is attached to the substantially groove-shaped to-be-attached portion 16. Either the first attachment portions 52 or the second attachment portion 54 may be formed in the housing 10, or alternatively all of such portions 52 and 54 may be formed in the housing 10. For example, either the first attachment portions 52 or the second attachment portion 54, or alternatively all of such portions 52 and 54 may be formed as arm-shaped hooks protruding from the housing 10. The substantially plate-shaped base portion 51 may be pinched by such hooks from the two sides of the base portion 51.

In addition, in the above-described embodiment, the second attachment portion 54 formed in the lock member 50 has a shape protruding downwards from the first extension portion 511 of the base portion 51, and is attached to the interstice between the left-and-right pair of engagement protrusions 16L and 16R included in the to-be-attached portion 16 of the housing 10. The shape of the second attachment portion 54 and that of the to-be-attached portion 16 are not limited to such shaped as ones described above. Any shapes of the portions 54 and 16 may be acceptable as long as the shapes allow the second attachment portion 54 to be attached to the housing 10. For example, one of the second attachment portion 54 and the to-be-attached portion 16 may be hole-shaped or recess-shaped while the other one of the portions 54 and 16 may have a protrusion shape configured to fit in the hole or the recess. As another example, the second attachment portion 54 of the lock member 50 may have a left-and-right pair of engagement portions formed symmetrically in the left-and-right direction with respect to the vertical line Z (see FIG. 8) passing on the center of the lock member 50. In addition, the to-be-attached portion formed in the housing 10 may fit between the two engagement portions of the second attachment portion 54.

The invention claimed is:

1. An electrical connector which is configured to house a terminal and lock the terminal therein, the terminal being connected to an end portion of a cable, the connector comprising:

a housing having a through-hole formed therethrough along a forward-rearward direction thereof, the through-hole configured to have the terminal inserted therein to allow the terminal to be electrically connected with a terminal of a mating connector; and a lock member attached to the housing and configured to lock the terminal inside the housing, wherein the lock member includes:

a substantially plate-shaped base portion positioned outside of the housing, the base portion extending along the forward-rearward direction, the base portion having left and right side faces separated from each other in a left-right direction, the left-right direction being orthogonal to the forward-rearward direction, the base portion having a forward face;

a first attachment portion extending from the base portion in an up-down direction, the up-down direction being orthogonal to both the forward-rearward direction and the left-right direction, the first attachment portion being configured to attach the lock member to the housing, the first attachment portion includes left and right attachment arms, the left attachment arm being provided at, or proximate to, the left side face of the base portion, the right attachment arm being provided at, or proximate to, the right side face of the base portion;

a second attachment portion which is configured to attach the lock member to the housing, the second attachment portion being provided at, or proximate to, the forward face of the base portion, the second attachment portion being positioned between the left and right attachment arms in the left-right direction; and a locking portion configured to lock the terminal so that the terminal is held inside the housing, wherein the base portion includes a first extension portion formed to extend forward from the first attachment portion, and wherein the base portion includes a second extension portion formed to extend rearward from the first attachment portion, wherein the second attachment portion is positioned on the first extension portion of the base portion and is separated from the first attachment portion, and wherein the locking portion extends from the second extension portion of the base portion in the up-down direction.

2. The electrical connector according to claim 1, wherein the housing includes a receptacle configured to accommodate a to-be-locked portion of the terminal, wherein the first attachment portion of the lock member is configured to engage with the housing in the receptacle of the housing, wherein the locking portion of the lock member is configured to engage with the to-be-locked portion of the terminal in the receptacle of the housing, and wherein the second attachment portion of the lock member is configured to engage with the housing at a position separated away, in the forward-rearward direction, from the receptacle of the housing and thus to attach the lock member to the housing.

3. The electrical connector according to claim 1, wherein the housing includes: a fitting portion configured to accommodate a contact portion of the terminal and to fit to the mating connector; a receptacle configured to accommodate a to-be-locked portion of the terminal; and a relay portion configured to accommodate a coupling portion of the terminal and to relay the fitting portion and the receptacle, the first attachment portion of the lock member is configured to engage with the housing in the receptacle of the housing, the locking portion of the lock member is configured to engage with the to-be-locked portion of the terminal in the receptacle of the housing, and the second attachment portion of the lock member is configured to engage with the housing in the relay portion of the housing and thus to attach the lock member to the housing.

4. The electrical connector according to claim 1, wherein the base portion of the lock member includes a surface which is opposite a surface facing the housing and on which guide rails extending in the forward-rearward direction are configured to receive an insertion of a clip member.

5. The electrical connector according to claim 1, wherein an engagement portion configured to engage with a clip member is formed in an end portion of the first extension portion of the base portion of the lock member and on a surface of the first extension portion that is opposite a surface facing the housing, and the second attachment portion is formed on the surface facing the housing at the same position where the engagement portion is formed.

6. The electrical connector according to claim 1, wherein the first extension portion of the lock member includes a tapered portion formed to include a pair of side faces that are obliquely inclined, and the second attachment portion is formed in the tapered portion.

7. An electrical connector comprising:

a terminal which is configured to be connected to an end portion of a cable;

a housing having a through-hole formed therethrough along a forward-rearward direction thereof, the through-hole configured to have the terminal inserted therein to house the terminal and to allow the terminal to be electrically connected with a terminal of a mating connector; and a lock member attached to the housing and configured to lock the terminal inside the housing, wherein the lock member includes:

a substantially plate-shaped base portion positioned outside of the housing, the base portion extending along the forward-rearward direction, the base portion having left and right side faces separated from each other in a left-right direction, the left-right direction being orthogonal to the forward-rearward direction, the base portion having a forward face;

a first attachment portion extending from the base portion in an up-down direction, the up-down direction being orthogonal to both the forward-rearward direction and the left-right direction, the first attachment portion being configured to attach the lock member to the housing, the first attachment portion includes left and right attachment arms, the left attachment arm being provided at, or proximate to, the left side face of the base portion, the right attachment arm being provided at, or proximate to, the right side face of the base portion;

a second attachment portion which is configured to attach the lock member to the housing, the second attachment portion being provided at, or proximate to, the forward face of the base portion, the second attachment portion being positioned between the left and right attachment arms in the left-right direction; and a locking portion configured to lock the terminal so that the terminal is held inside the housing, wherein the base portion includes a first extension portion formed to extend forward from the first attachment portion, and wherein the base portion includes a second extension portion formed to extend rearward from the first attachment portion, wherein the second attachment portion is positioned on the first extension portion of the base portion and is separated from the first attachment portion, and wherein the locking portion extends from the second extension portion of the base portion in the up-down direction.

8. The electrical connector according to claim 7, wherein the terminal includes a to-be-locked portion formed to be locked by the locking portion of the lock member, the housing includes a receptacle configured to accommodate the to-be-locked portion of the terminal, wherein the first attachment portion of the lock member is configured to engage with the housing in the receptacle of the housing, wherein the locking portion of the lock member is configured to engage with the to-be-locked portion of the terminal in the receptacle of the housing, and wherein the second attachment portion of the lock member is configured to engage with the housing at a position separated away, in the forward-rearward direction, from the receptacle of the housing and thus to attach the lock member to the housing.

9. The electrical connector according to claim 7, wherein the terminal includes: a contact portion configured to be in contact with a terminal of a mating connector; a to-be-locked portion configured to be locked by the locking portion of the lock member; and a coupling portion configured to couple the contact portion and the to-be-locked portion, and the terminal is formed by integrating the contact portion, the to-be-locked portion, and the coupling portion in the forward-rearward direction, the housing includes: a fitting portion configured to accommodate the contact portion of the terminal and to fit to the mating connector; a receptacle configured to accommodate the to-be-locked portion of the terminal; and a relay portion configured to accommodate the coupling portion of the terminal and to relay the fitting portion and the receptacle, the first attachment portion of the lock member is configured to engage with the housing in the receptacle of the housing, the locking portion of the lock member is configured to engage with the to-be-locked portion of the terminal in the receptacle of the housing, and the second attachment portion of the lock member is configured to engage with the housing in the relay portion of the housing and thus to attach the lock member to the housing.

10. The electrical connector according to claim 7, wherein the base portion of the lock member includes a surface which is opposite a surface facing the housing and on which guide rails extending in the forward-rearward direction are configured to receive an insertion of a clip member.

11. The electrical connector according to claim 7, wherein an engagement portion configured to engage with a clip member is formed in an end portion of the first extension portion of the base portion of the lock member and on a surface of the first extension portion that is opposite a surface facing the housing, and the second attachment portion is formed on the surface facing the housing at the same position where the engagement portion is formed.

12. The electrical connector according to claim 7, wherein the first extension portion of the lock member includes a tapered portion formed to include a pair of side faces that are obliquely inclined, and the second attachment portion is formed in the tapered portion.

* * * * *